US009120643B2

(12) United States Patent
Meierhans et al.

(10) Patent No.: US 9,120,643 B2
(45) Date of Patent: Sep. 1, 2015

(54) ELEVATOR BRAKING DEVICE

(71) Applicants: Daniel Meierhans, Lucerne (CH); Faruk Osmanbasic, Cham (CH); Marcus Junig, Emmenbrucke (CH); Michael Geisshusler, Lucerne (CH); Nicolas Gremaud, Richterswil (CH); Josef A. Muff, Hildisrieden (CH)

(72) Inventors: Daniel Meierhans, Lucerne (CH); Faruk Osmanbasic, Cham (CH); Marcus Junig, Emmenbrucke (CH); Michael Geisshusler, Lucerne (CH); Nicolas Gremaud, Richterswil (CH); Josef A. Muff, Hildisrieden (CH)

(73) Assignee: Inventio AG, Hergiswil (CH)

( * ) Notice: Subject to any disclaimer, the term of this patent is extended or adjusted under 35 U.S.C. 154(b) by 334 days.

(21) Appl. No.: 13/625,340

(22) Filed: Sep. 24, 2012

(65) Prior Publication Data

US 2013/0081907 A1 Apr. 4, 2013

(30) Foreign Application Priority Data

Sep. 30, 2011 (EP) ..... 11183387

(51) Int. Cl.
*B66B 5/20* (2006.01)
*B66B 5/18* (2006.01)

(52) U.S. Cl.
CPC .... *B66B 5/18* (2013.01); *B66B 5/20* (2013.01)

(58) Field of Classification Search
CPC ..... B66B 5/12; B66B 5/22
USPC ..... 187/368, 359
See application file for complete search history.

(56) References Cited

U.S. PATENT DOCUMENTS

| | | | | | |
|---|---|---|---|---|---|
| 3,706,361 | A * | 12/1972 | Paulssen et al. | ..... | 188/189 |
| 3,783,978 | A * | 1/1974 | Hamilton | ..... | 187/278 |
| 5,096,020 | A * | 3/1992 | Korhonen | ..... | 187/376 |
| 5,199,532 | A * | 4/1993 | Suganuma et al. | ..... | 187/359 |
| 5,234,079 | A * | 8/1993 | Nomura | ..... | 187/250 |
| 5,363,942 | A * | 11/1994 | Osada | ..... | 187/376 |
| 5,377,786 | A * | 1/1995 | Nakagawa | ..... | 187/287 |
| 5,819,879 | A * | 10/1998 | Lang et al. | ..... | 187/376 |
| 6,173,813 | B1 * | 1/2001 | Rebillard et al. | ..... | 187/287 |
| 6,176,350 | B1 * | 1/2001 | Schlosser | ..... | 187/368 |
| 6,318,505 | B1 * | 11/2001 | De Angelis | ..... | 187/292 |
| 6,902,369 | B2 * | 6/2005 | Tanigawa | ..... | 414/674 |
| 7,080,717 | B2 * | 7/2006 | Ito | ..... | 187/350 |
| 7,134,529 | B2 * | 11/2006 | Maury | ..... | 187/359 |
| 7,267,201 | B2 * | 9/2007 | Ito | ..... | 187/372 |
| 7,398,863 | B2 * | 7/2008 | Liebetrau et al. | ..... | 187/367 |
| 7,575,099 | B2 * | 8/2009 | Oh et al. | ..... | 187/286 |
| 7,650,969 | B2 * | 1/2010 | Monzon et al. | ..... | 187/300 |
| 7,849,972 | B2 * | 12/2010 | Higashinaka | ..... | 187/351 |
| 8,186,483 | B2 * | 5/2012 | Sirigu et al. | ..... | 187/366 |

(Continued)

FOREIGN PATENT DOCUMENTS

EP 2194014 A1 6/2010

*Primary Examiner* — William A Rivera
*Assistant Examiner* — Michael Riegelman
(74) *Attorney, Agent, or Firm* — Fraser Clemens Martin & Miller LLC; William J. Clemens

(57) ABSTRACT

In an elevator installation an elevator cage is movable along at least two guide rails and the elevator cage is equipped with a braking system. An elevator braking device includes a brake element, a force store, which is constructed to press the brake element against the brake surface, and an actuator, which can act on the brake element and which is constructed in order to press, in a first operational setting, the brake element against the force of the force store away from the brake surface or to hold it at a spacing therefrom and in order to free, in a second operational setting, pressing of the brake element against the brake surface.

18 Claims, 7 Drawing Sheets

(56) References Cited

U.S. PATENT DOCUMENTS

| | | | | |
|---|---|---|---|---|
| 2004/0262091 | A1* | 12/2004 | Ito | 187/372 |
| 2005/0126862 | A1* | 6/2005 | Ito | 187/350 |
| 2006/0090969 | A1* | 5/2006 | Eckenstein et al. | 188/65.1 |
| 2008/0128218 | A1* | 6/2008 | Gremaud et al. | 187/250 |
| 2010/0038184 | A1* | 2/2010 | Emmerich et al. | 187/288 |
| 2011/0100761 | A1* | 5/2011 | Dudde et al. | 187/359 |
| 2012/0152658 | A1* | 6/2012 | Osmanbasic | 187/288 |
| 2012/0152659 | A1* | 6/2012 | Husmann et al. | 187/373 |
| 2012/0152663 | A1* | 6/2012 | Legeret et al. | 187/404 |
| 2013/0081908 | A1* | 4/2013 | Meierhans et al. | 187/359 |
| 2013/0105250 | A1* | 5/2013 | Meierhans et al. | 187/350 |
| 2013/0133984 | A1* | 5/2013 | Osmanbasic et al. | 187/306 |
| 2013/0175120 | A1* | 7/2013 | Bray et al. | 187/359 |
| 2013/0213750 | A1* | 8/2013 | Meierhans et al. | 188/261 |
| 2013/0248298 | A1* | 9/2013 | Osmanbasic et al. | 187/359 |
| 2014/0216857 | A1* | 8/2014 | Mizuno et al. | 187/359 |

* cited by examiner

Fig. 4
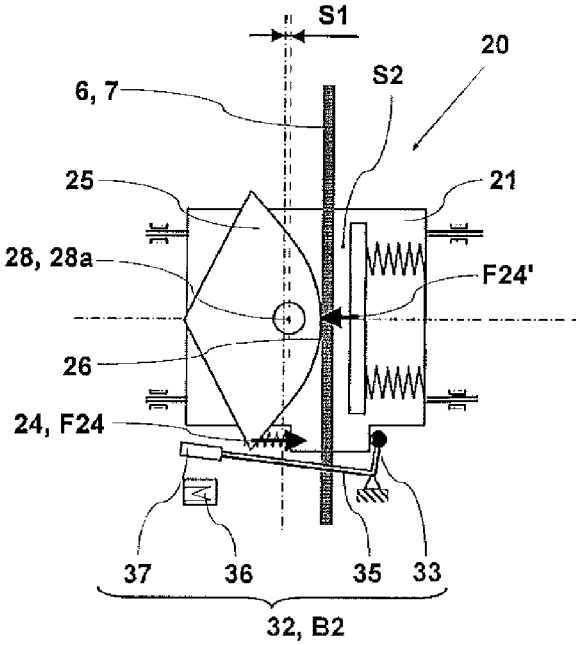
Fig. 5
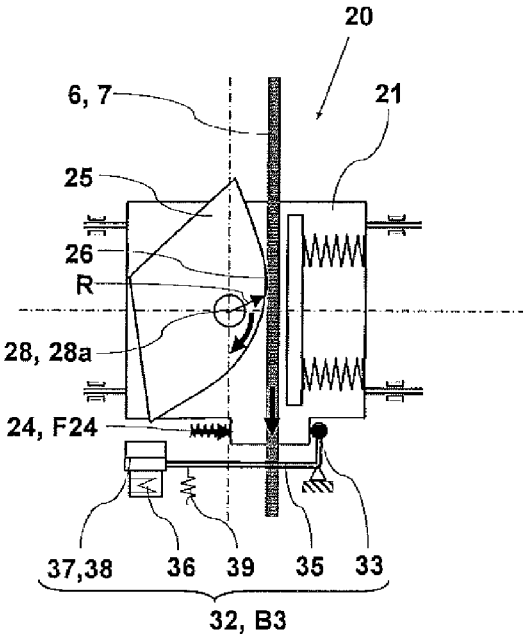
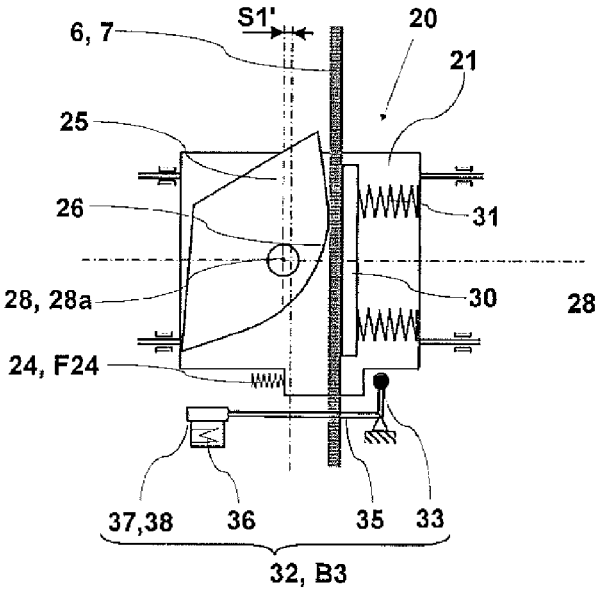
Fig. 6
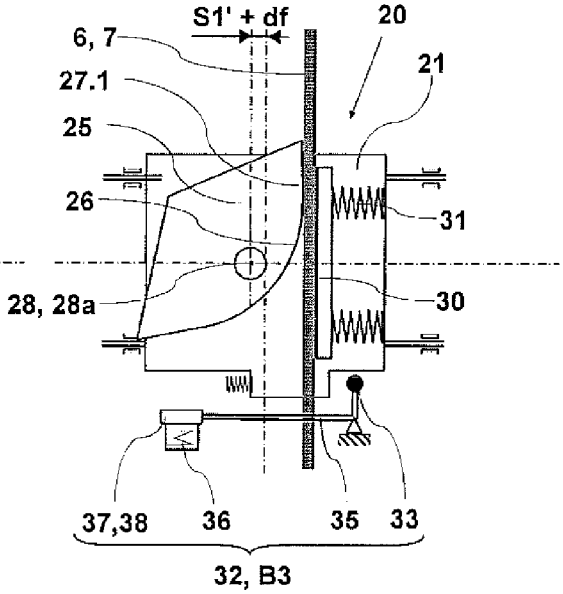
Fig. 7

ELEVATOR BRAKING DEVICE

CROSS-REFERENCE TO RELATED APPLICATION

This application claims priority to European Patent Application No. 11183387.7, filed Sep. 30, 2011, which is incorporated herein by reference.

FIELD

The disclosure relates to a braking device for braking an elevator cage.

BACKGROUND

The elevator installation is installed in a building. It consists substantially of a cage which is connected with a counterweight or with a second cage by way of support means. The cage is moved along substantially vertical guide rails by means of a drive, which acts selectably on the support means or directly on the cage or the counterweight. The elevator installation is used in order to convey persons and goods within the building over individual or several stories. The elevator installation includes devices in order to safeguard the elevator cage in the case of failure of the drive or the support means. For that purpose, use is usually made of braking devices which can brake the elevator cage on the guide rails when required.

SUMMARY

At least some disclosed embodiments comprise a braking device which can produce braking of the elevator cage. The braking device can be electrically actuable and it can be resettable in simple manner.

An elevator braking device is proposed which can be suitable for retarding and holding an elevator cage in co-operation with a brake surface when required. Possibly, this elevator braking device is arranged on a car of the elevator, for example the elevator cage, and it can co-operate with guide rails which are, for this purpose, provided with brake surfaces. The brake surfaces can also be used multi-functionally for guidance of the car. The elevator braking device can also be analogously arranged in the region of the drive and the brake surface can be a surface of a brake disc or also of a cable, for example a cable surface.

The elevator braking device comprises at least one brake element. The brake element is constructed to be self-energizing. It includes for that purpose a shape similar to an eccentric or another form of amplifying curve. Self-energizing means that the brake element, after it has been moved up to the brake surface by an initial force, automatically moves into a braking setting by a relative movement between elevator braking device and brake surface. The brake element is possibly arranged in a brake housing by means of a rotary bearing to be rotatable and it has a curved shape which is so formed that a radial spacing of the curve from the rotary bearing increases over a rotational angle. As a result, the self-energization is achieved when the brake element rotates. The initial force, which can be necessary for moving the brake element up to the brake surface, is provided by a force store. The force store is possibly a stressed spring. Pneumatic, hydraulic or—depending on the respective field of use—also a weight-based force store can be used. The elevator braking devices further comprises an actuator which can act on the brake element. In normal operation, the actuator holds the brake element in a first operational setting. In that regard it presses the brake element against the force of the force store away from the brake surface or it holds the brake element at a spacing therefrom. An unbraked movement of the car is thus made possible. When required, the actuator frees the brake element, whereby the force store can bring the brake element into a second operational setting and whereby pressing of the brake element against the brake surface can take place. As soon as the brake element is pressed against the brake surface, it is entrained by the relative movement between elevator braking device and brake surface. Through this entrainment the brake element is in turn moved in such a manner that the brake element moves the actuator back into a reset position corresponding with the first operational setting. The actuator is thus again disposed in its original position corresponding with normal operation. This can mean that a holding mechanism of the actuator, for example an electromagnet or a latch, for fixing the actuator in this reset position corresponding with the first operational setting only has to be switched on. The actuator is thus reset without a further resetting action. The holding mechanism can accordingly be of economic design.

In an embodiment, the brake element is incorporated in the brake housing. The force store and the actuator are constructed so that they act on the brake element by way of the brake housing. Possibly, in this regard the brake housing is horizontally displaceable, for example mounted and held in a support, and the actuator is similarly mounted in this support. This can be advantageous, since many currently employed elevator braking devices already have a brake housing which often is even already mounted to be horizontally displaceable. The proposed embodiment can thus be realized economically, since in supplement to known elevator braking devices the brake housing merely has to be fixed by an actuator and adjusted by a force store.

In another embodiment the brake element itself is displaceably mounted in the brake housing so that it can be adjusted perpendicularly to the brake surface. The force store and the actuator are so constructed that they act on the brake element. For example, in this regard the brake element is mounted in the brake housing to be horizontally displaceable. The actuator, which can be similarly mounted in the brake housing, now makes it possible for the brake element to be adjusted in the brake housing with respect to the brake surface. By virtue of the self-energizing characteristic of the brake element the brake element in the case of subsequent actuation is reset or pushed back in the brake housing and the actuator can follow this resetting movement, whereby it again comes to lie in its original, normal position.

The brake element of the elevator braking device is, in a variant of embodiment, rotatably mounted in the brake housing by means of the rotary bearing. The curved shape of the brake element defines a central clamping region which, for example, is formed to be eccentric with respect to the rotary bearing or as a control cam, so that a spacing from the rotary bearing to curved sections, which follow one another, of the clamping region increases over a rotational angle. Thus, a self-energization takes place in the case of a relative movement between elevator braking device and brake surface, since an axis of the rotary bearing is displaced back during rotation of the brake element. After a first displacement, the axis of the rotary bearing again reaches its original position corresponding with the first operational setting and the actuator can follow this resetting movement, whereby it again comes to lie in its original, normal position.

The further relative movement between elevator braking device and brake surface has the effect that the brake element is rotated again, whereby a further amplification results. This further amplification firstly has the effect that, for example, a brake plate opposite the brake surfaces is drawn towards the brake counter-surface and clamped again until a sufficient clamping force and corresponding braking force are achieved. The further amplification obviously also has the effect that the axis of the rotary bearing is again displaced back. Since the actuator as a rule has already reached its position corresponding with first operational setting a play can arise between the brake element or brake housing and the actuator in this operational position.

Alternatively, the holding mechanism can also be resiliently mounted so as to enable a corresponding urging back.

In a variant of embodiment the brake element has a first braking region which is connected with the central clamping region. This can be helpful in the case of higher speeds. The eccentric thus does not have to roll over an entire braking travel, but the braking region ends the rolling and amplifying process and the car is stopped by the braking region and the braking force of the opposite brake plate. The brake element possibly has a second braking region, which is connected with the end of the central clamping region opposite the first braking region. It is thus possible to provide an elevator braking device which acts at both sides, since the brake element is necessarily correctly moved in correspondence with a travel direction.

In an alternative variant of embodiment the brake element has a brake shoe instead of a first braking region. This is pressed against the brake surface by, for example, a control eccentric of the brake element, through rotation of the same.

In a variant of embodiment the elevator braking device further comprises a brake plate. This brake plate is arranged in such a manner that the brake surface or corresponding guide rail can be clamped in place between the brake element and the brake plate. The brake plate is possibly fastened in the brake housing by means of at least one brake spring. The brake spring is designed in correspondence with a mass of the car to be braked. With consideration of the geometric layout of the brake element and a resultant yielding of the brake spring it is possible to determine a stiffness or spring constant and bias thereof. Thus, on the one hand the engagement and reset functionality can be triggered by means of a shape of a brake element and on the other hand a braking force can be set by means of the design of the brake plate with brake spring.

In a variant of embodiment the actuator comprises a clamping electromagnet with an armature plate. In the first operational setting the armature plate bears against the clamping electromagnet and it is electromagnetically held by this. The actuator is thus held in the first operational setting and the brake element is correspondingly held with transit play relative to the brake surface. Denoted as transit play is an air gap which in the operating position is present between brake element and brake rail in order to enable movement of the elevator cage or the counterweight. The armature plate lies directly at the electromagnet. Accordingly, a low current is sufficient in order to maintain a required magnetic field and holding force. If the current circuit of the electromagnet is interrupted, the magnetic field decays and the brake element can be adjusted with respect to the brake surface. As already explained in the foregoing, the actuator is moved in such a manner by the relative movement between elevator braking device and the brake surface that it again comes into the reset position corresponding with the first operational setting. The armature plate is in that case brought into contact with the clamping electromagnet independently of a current-conducting state of the electromagnet.

A subsequent resetting of the elevator braking device can thus take place in a simple manner. Merely the current circuit for the electromagnet can be switched on. Since the armature plate already lies at the electromagnet, the armature plate and thus the actuator are immediately fixed. It is not necessary to overcome an air gap between electromagnet and armature plate. Through a rearward movement of the car and thus of the elevator braking device the brake element can be moved out of the biased braking position directly into the first operational setting.

In a variant of embodiment the actuator is settable so as to enable setting of the first operational setting. Thus, for example, a transit play between brake surface and brake element can be precisely set.

In a variant of embodiment the actuator includes an assisting weight. This assisting weight constantly urges the actuator opposite to the action of the force store and it can thus hold an entrainer, possibly a blocking roller, in contact with the brake element or the brake housing. The assisting weight can, for example, already be the weight of the armature plate itself or it can also be an additional weight element. Alternatively or additionally use can also be made of an assisting spring which holds the entrainer, possibly the blocking roller, in contact with the brake element or the brake housing.

Overall, an elevator braking device of that kind is installed in or attached to an elevator installation with the elevator cage and possibly directly at the same. The brake surface is a direct component of the guide rail and the elevator braking device clamps a web of the guide rail for the purpose of retention and braking.

Possibly, the elevator cage is provided with two elevator braking devices and these elevator braking devices can act on two guide rails arranged on opposite sides of the elevator cage. These two elevator braking devices are possibly coupled by a synchronization rod and possibly each elevator braking device comprises a respective actuator. The safety of the elevator braking device can thus be increased, since in the case of failure of the one of the actuators the remaining actuator synchronously actuates the two elevator braking devices by way of the synchronization rod. Braking at one side can thus be precluded.

BRIEF DESCRIPTION OF THE DRAWINGS

The disclosure is explained using the figures, in which:

FIG. 4 shows the elevator braking device of FIG. 3 in a second operational setting, FIG. 5 shows the elevator braking device of FIG. 3 in a reset position corresponding with the first operational setting, FIG. 6 shows the elevator braking device of FIG. 3 in a clamping setting, FIG. 7 shows the elevator braking device of FIG. 3 in a braking setting.

In the figures the same reference numerals are used in all figures for equivalent parts.

DETAILED DESCRIPTION

Figure 1:
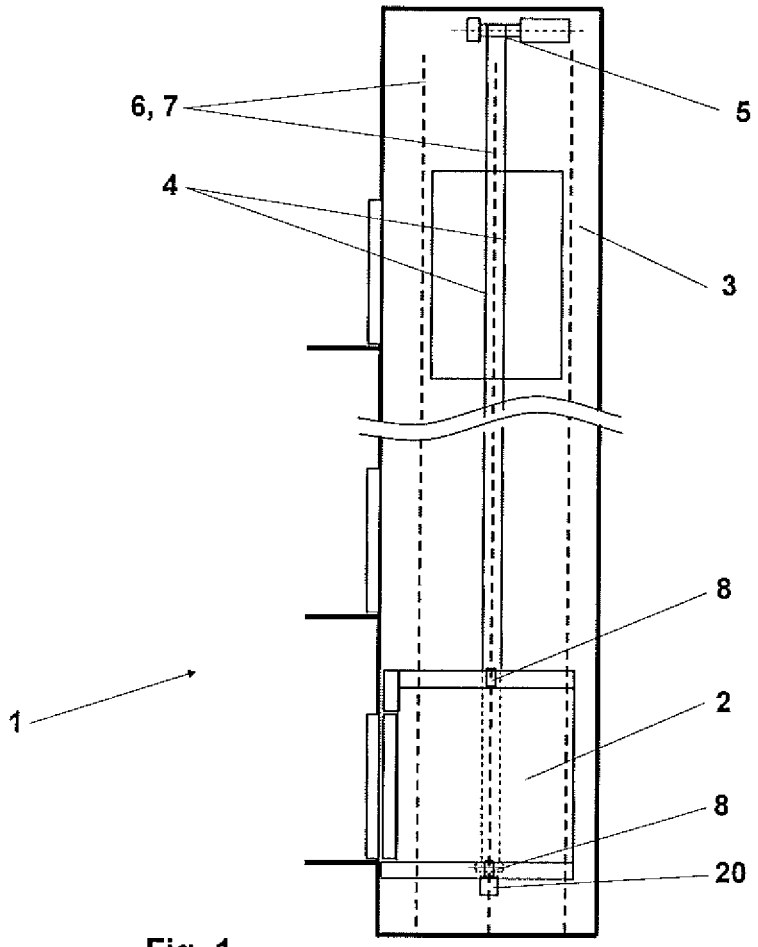
FIG. 1 shows a schematic view of the elevator installation in side view.

FIG. 1 shows an elevator installation 1 in an overall view. The elevator installation 1 is installed in a building and serves for the transport of persons or goods within the building. The elevator installation includes an elevator cage, which can move upwardly and downwardly along guide rails 6. The elevator cage 2 is for that purpose provided with guide shoes 8, which guide the elevator cage, possibly precisely as possible along a predetermined travel path. The elevator cage 2 is accessible from the building by way of doors. A drive 5 serves for driving and holding the elevator cage 2. The drive 5 is arranged in, for example, the upper region of the building and the cage hangs at the drive 5 by support means 4, for example support cables or support belts. The support means are guided by way of the drive 5 onward to a counterweight 3. The counterweight compensates for a mass component of the elevator cage 2 so that the drive 5 primarily merely has to compensate for an imbalancing weight between cage 2 and counterweight 3. In the example, the drive 5 is arranged in the upper region of the building. It could also be arranged at another location in the building, or in the region of the cage 2 or the counterweight 3.

The elevator cage 2 is equipped with a braking system which is suitable for securing and/or retarding the elevator cage 2 in the case of an unexpected movement or in the case of excess speed. In the example, the braking system is arranged below the cage 2 and it is electrically activated (not illustrated). A mechanical speed limiter, such as is usually used, can accordingly be eliminated.

Figure 2:
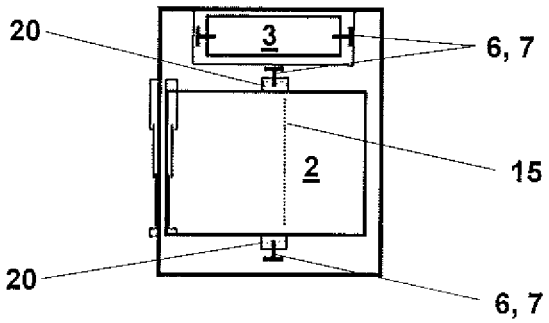
FIG. 2 shows a schematic view of the elevator installation in cross-section.

FIG. 2 shows the elevator installation of FIG. 1 in a schematic plan view. The braking system contains two elevator braking devices 20. The two elevator braking devices 20 are, in this example, coupled by means of a synchronization rod 15 so that the two elevator braking devices 20 are actuated together. An unintended braking at one side can thus be avoided. The two elevator braking devices 20 are possibly realized to be constructionally the same or with mirror symmetry and they act when required on the guide rails arranged on both sides of the cage 2. The guide rails 5 include for that purpose brake surfaces 7 which in co-operation with the elevator braking devices 20 can effect braking of the elevator cage 2. It is also possible to dispense with the synchronization rod 15. However, electrical synchronization means are then recommended, which can help ensure simultaneous triggering of elevator braking devices arranged on both sides of the elevator cage.

Figure 3:
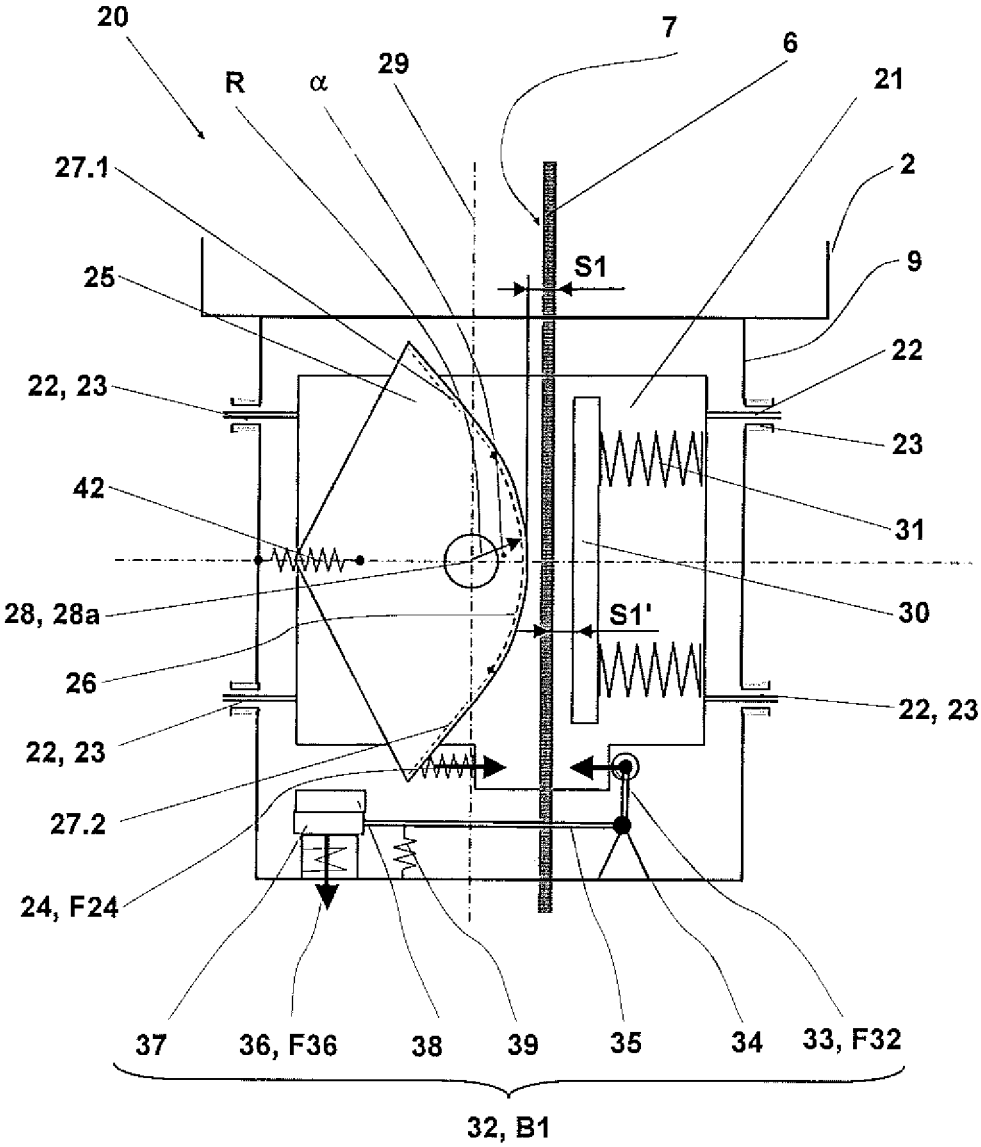
FIG. 3 shows a schematic view of an elevator braking device in a first operational setting.
Figure 8:
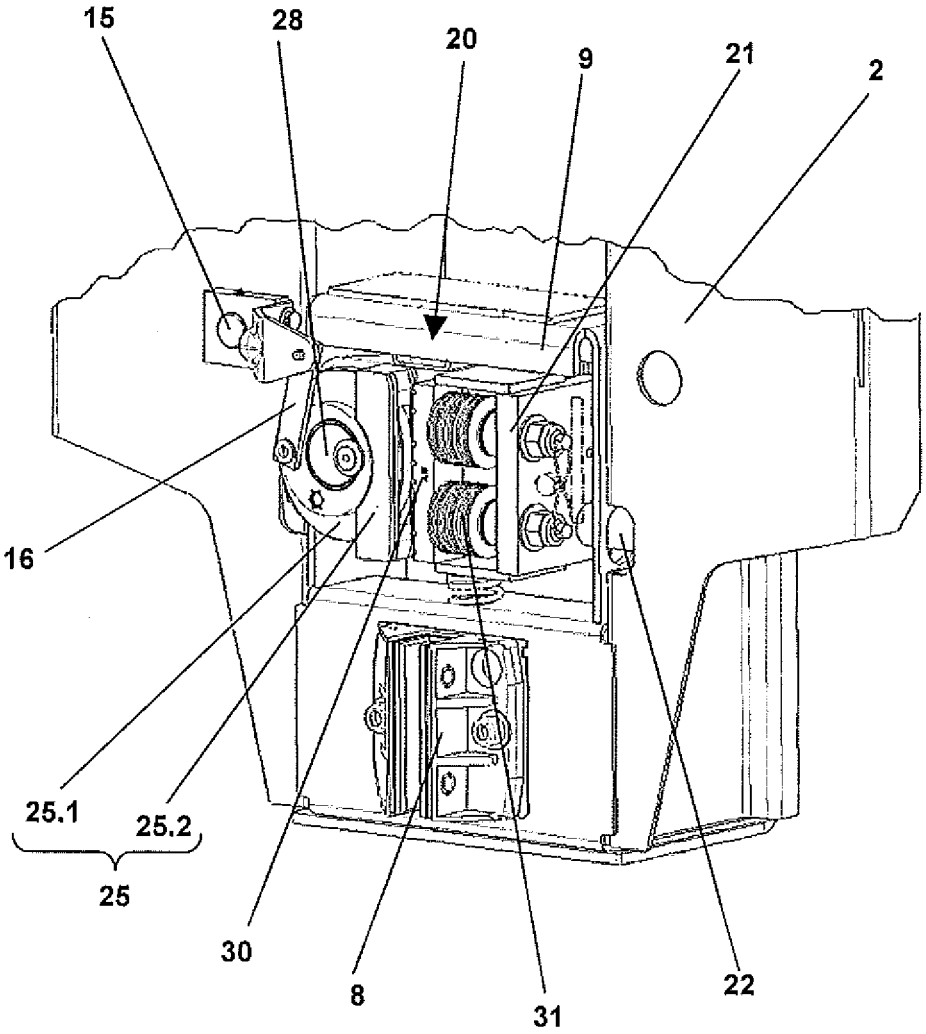
FIG. 8 shows a perspective view of a realized elevator braking device.

FIG. 3 shows a possible embodiment of an elevator braking device 20. The elevator braking device 20 is constructed so as to co-operate with a brake surface 7. This brake surface 7 is a component of the guide rail 6.

The elevator braking device 20 is disposed in a first operational setting B1. In this setting, the elevator braking device 20 does not brake, i.e. the elevator cage 2 can travel. The elevator braking device 20 comprises a brake housing 21, which is arranged in a support 9 to be slidable by way of a slide connection. The slide connection substantially comprises a sliding guide 23, which is arranged in the support 9 and the brake housing 21 is mounted in this sliding guide 23 by way of a guide rod 22. The support 9 is fastened to the elevator cage 2 or it is a component of the elevator cage 2. The elevator cage 2 and thus the support 9 are guided along the guide rail 6 by means of a guide shoe 8 (see FIGS. 1 and 2).

Other forms of slide connections are also possible. Thus, the brake housing 21 could, for example, slide in slide tracks of the support 9 or it could be connected by way of a pivot bearing with the elevator cage 2 or support 9. The brake housing 21 is thus arranged to be displaceable horizontally or perpendicularly to the brake surface 7. A brake element 25 is arranged in the brake housing 21.

The brake element 21 is connected with the brake housing 21 by way of a rotary bearing 28. In the illustrated embodiment the brake element 25 has a first clamping region 26. In the first operational setting (B1) the brake element 25 is disposed in a middle position. This middle position is set by, for example, a centering spring 42. The centering spring 42 engages the brake element 25 and pulls it by a low force into the middle position, as apparent in FIG. 3. The clamping region 26 is so realized with respect to a longitudinal axis 28*a* of the rotary bearing 28 or describes a curved shape in such a manner that a radial spacing R from the longitudinal axis 28*a* to the clamping region 26 increases, starting from the center position, over a rotational angle $\alpha$. A braking region 27.1, 27.2 is connected with the clamping region 26. The braking region 27.1, 27.2, as a tangential continuation of the clamping region 26, snugly adjoins this. In the example, the brake element 25 has a first braking region 27.1 and a second braking region 27.2, which are arranged at the two ends of the clamping region 26. This braking element is provided for braking in both travel directions. The clamping region 26 is possibly provided with a knurling or with transverse grooves so as to enable good gripping of the clamping region 26 with the brake surface 7. The braking region 27.1, 27.2 is realized as a brake lining. It can include a special braking material such as, for example, ceramic, sintered material or hardened brake shoes.

An actuator 32 and a force store 24 are arranged in the support 9. The actuator 32 forms, by way of a blocking roller 33 or a corresponding entrainer, an abutment for the brake housing 21 and thus for the brake element 25. The force store 24—in the example, a compression spring—presses the brake housing 21 and thus the brake element 25 against the actuator 32. The position of the brake element 25 with respect to the guide rail 6 and thus with respect to the brake 7 is thus determined. The position of the actuator 32 and thus the position of the brake element 25 can, if required, be precisely set by suitable setting means. The actuator 32 is fixed by a retaining device, in the example in the form of a clamping electromagnet 36 and associated armature plate 37.

In addition, a brake plate 30 is disposed opposite the brake element 25. The brake plate 30 is arranged in the brake housing 21 and supported in this by way of brake springs 31. The brake plate 30 is so arranged that the guide rail 6 projects into the intermediate space defined by brake plate 30 and brake element 25. A spacing between brake plate 30 and brake element 25 is so selected in the first operational position B1 that a sufficient transit play S1, S1' is ensured with respect to the guide rails 6 or the corresponding brake surfaces. The brake plate 30 could alternatively also be realized as a fixed counter-lining, without resilient support by means of brake springs, or it could be realized in the form of a brake wedge. It may thereby be possible, for example, to achieve an additional amplification of braking force in dependence on travel direction.

A pressing-on force F24 of the force store 24 is so selected that in the case of actuation the brake element 25 is so strongly pressed against the brake surface 7 that on relative movement between brake surface 7 and brake housing 21 it is securely entrained. In one embodiment a force of at least approximately 85 N (Newtons) is required for that purpose. With consideration of friction losses such as arise, for example, in the case of coupling of two elevator braking devices 20, as illustrated in the example of FIGS. 1 and 2 by means of the synchronization rod 15, an effective retaining force F32 of the actuator 32 is, in the example, approximately 1000 N (Newtons). A sufficient security is thus present for the elevator braking device 20 not to be actuated due to vibrations and at the same time the force store 24 can be sufficiently strongly dimensioned so that in every instance a reliable actuation of the elevator braking device 20 can take place. With consideration of a lever ratio of approximately 1:4 at the actuator 32 a required magnetic retaining force F36 approximately 250 N results. A corresponding clamping electromagnet has a diameter of approximately 25 mm (millimeters) for a constructional height of approximately 20 mm (millimeters). An actuating system of that kind can thus be realized with small dimensions. It requires little space. These value details are informatory. They can be established by the skilled person on the bases of the geometric and constructional realization of the participating components.

For actuation of the elevator braking device 20, in a first step, as apparent in FIG. 4, the clamping electromagnet 36 is switched to be free of current and the armature plate together with the complete actuator 32 is free. The pressing force F24 of the force store 24 is thereby free and presses the brake housing 21 and thus brake element 25 by the corresponding pressing force F21' against the guide rail 6 or the corresponding brake surface 7. The longitudinal axis 28*a* of the rotary bearing 28 is thus adjusted by the amount of the transit play S1. In the example, the entire brake housing 21 has displaced together with the brake element 25. Accordingly, a transit play S2 on the opposite side of the guide rail correspondingly increases.

In a subsequent relative movement between brake surface 7 and brake housing 21 the pressing force F24 has the effect that the clamping region 26 is entrained by the brake surface 7. The clamping region 26 is for that purpose possibly structured or knurled. Through entraining the clamping region 26 the brake element 25 rotates about the axis 28 of rotation. The longitudinal axis 28*a* is, in correspondence with the increase in the radial spacing R from the longitudinal axis 28*a* to the clamping region 26, pushed back in the direction of the original, first operational setting. In FIG. 5 it is apparent how in the course of pushing back the longitudinal axis 28*a* and thus also the brake housing 21 regain the position corresponding with the first operational setting. Due to the weight matching of the actuator 32 the armature plate 37 again lies at the clamping electromagnet 36. The weight matching results from the arrangement of the lever 35, the armature plate 37 and the influence of a possible assisting spring 39 or a corresponding assisting weight 38.

However, the clamping region 26 further rotates, as apparent in FIG. 6, and ultimately pushes back the brake housing 21 in such a manner that the brake plate 30 similarly lies against the guide rail 7 and it continues to rotate until the braking region 27.1 is reached, as illustrated in FIG. 7. Up to this working point the longitudinal axis 28 and thus equally the braking housing 21 were further reset, whereby ultimately the brake springs 31 of the brake plate 30 are stressed. Through the pressing force, which is built up in that manner, of brake plate 30 and braking region 27.1 against the brake surfaces 7 of the rail 6 braking of the elevator cage 2 finally takes place.

As apparent in FIGS. 6 and 7, after the actuator 32 has reached its reset position, i.e. when the armature plate 37 rests against the clamping electromagnet 36, the brake housing 21 can if required be moved away from the actuator 32 or the blocking roller 33 thereof. It is critical that the actuator 32 in this brake setting of the elevator braking device 20 is again in a reset position B3 corresponding with the first operational setting.

Insofar as the elevator braking device 20 is now to be rest, as a first step a retaining current of the clamping electromagnet 36 can be switched on. The actuator 32 is thereby fixed or held without the clamping electromagnet 36 having to bring about an air gap or other form of resetting energy.

For resetting, it can be merely necessary for the elevator cage 2 to be moved back oppositely to the previous braking direction. The brake element 25 is thereby rotated back and the brake housing 21 is set by the force store 24 and the fixed actuator 32 into the first operational setting B1, as illustrated in FIG. 3. The brake element 25 is itself brought back into its center position by, for example, the centering spring 42.

Another embodiment is illustrated in FIGS. 8 to 14. Basically, in this embodiment a safety brake device is integrated in the elevator braking device, as is known from, for example, the publication DE 2139056. The elevator braking device 20 is integrated in a structure of the elevator cage 2. The elevator cage 2 also includes the guide shoe 8, which is provided for guidance of the elevator cage along guide rails (not illustrated). The elevator braking device 20 includes a brake element 25 with a clamping region in the form of a control eccentric 25.1 and brake shoes 25.2, which are mounted in the brake housing 21 to be rotatable about an axis 28 of rotation. A synchronization rod 15 with synchronization lever 16 connects the two elevator braking devices 20 arranged on either side of the elevator cage 2. It is thereby ensured that the two elevator braking devices 20 come into engagement with one another. It is also possible to selectively provide, at this synchronization rod, centering parts (not illustrated) which set a center position of the control eccentric 25.1, and switches (not illustrated) can be provided, which can establish a rotation of the synchronization rod and thus an operational setting of the elevator braking device 20.

The brake housing 21 is fastened to the elevator cage 2 by way of the support 9, wherein a guide rod 22 enables a lateral or horizontal displacement of the brake housing 21 with respect to the support 9 and the guide rail 6.

Figure 9:
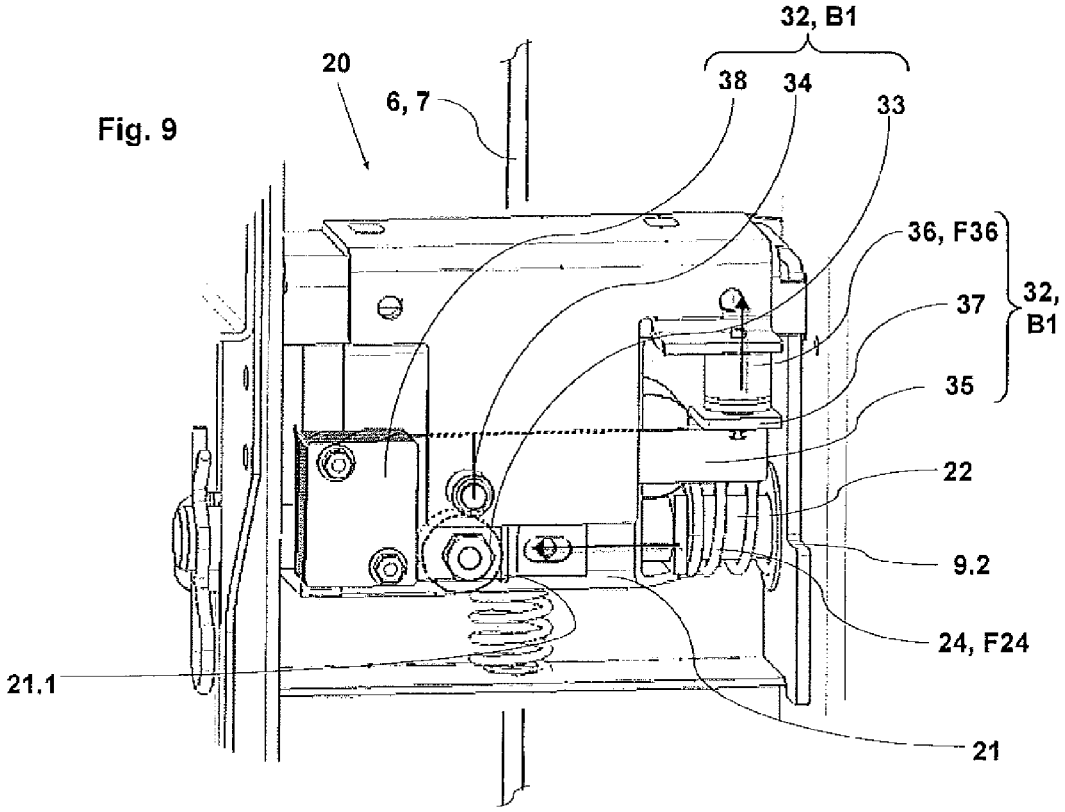
FIG. 9 shows a back view of the brake of FIG. 8 in the first operational setting.
Figure 10:
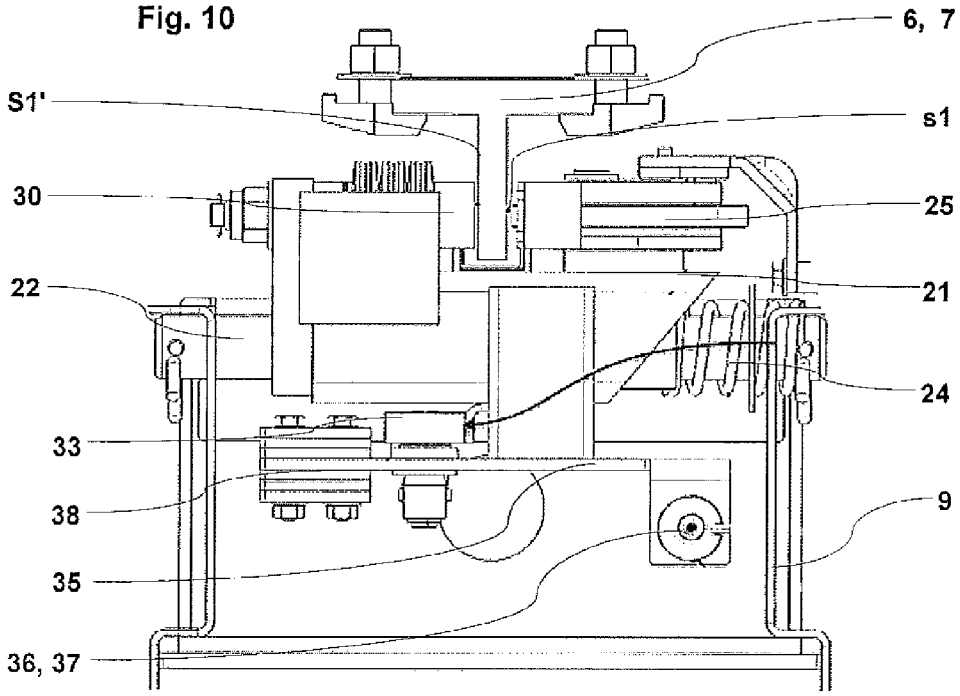
FIG. 10 shows a plan view of the brake of FIG. 8 in the first operational setting.

In normal operation or in the first operational setting BM, the brake element 25 and the brake plate 30 are arranged at a spacing from the guide rail 6, as illustrated in FIGS. 9 and 10. FIG. 9 shows in this regard a perspective back view and FIG. 10 shows a plan view of the elevator braking device 20 in the first operational setting BP1. The actuator 32 is fixed by the clamping electromagnet 36 and the blocking roller 33 of the actuator 32 holds the brake housing 21 by way of a settable abutment 21.1, against the effective force F24 generated by the force store 24, in the first operational setting. As an alternative to the settable abutment 21.1, the position of the brake housing 21 can also be set by way of the blocking roller 33. For that purpose the blocking roller 33 can, for example, be fastened to the blocking lever 35 by an eccentrically formed axle. Through rotation of this axle of the blocking roller 33 the lateral position of the brake housing 21 in the support 29 and thus the position with respect to the brake surface 7 or guide rail 6 can be precisely set.

Figure 11:
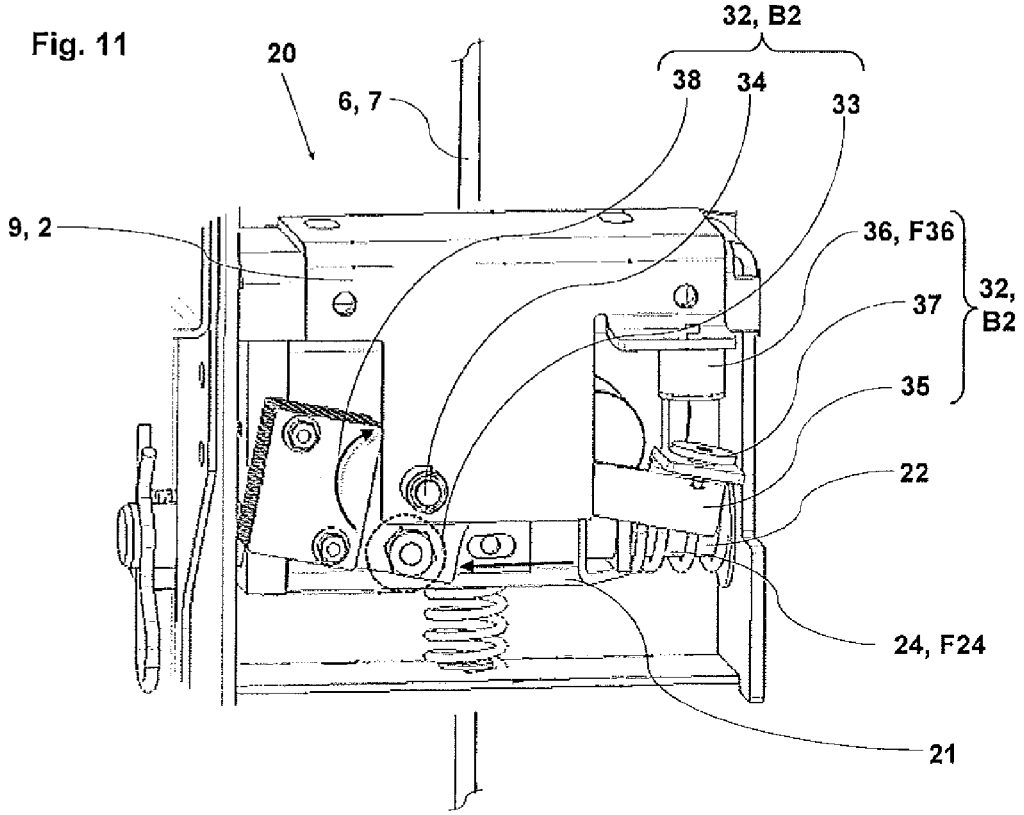
FIG. 11 shows a back view of the brake of FIG. 8 in the second operational setting.
Figure 12:
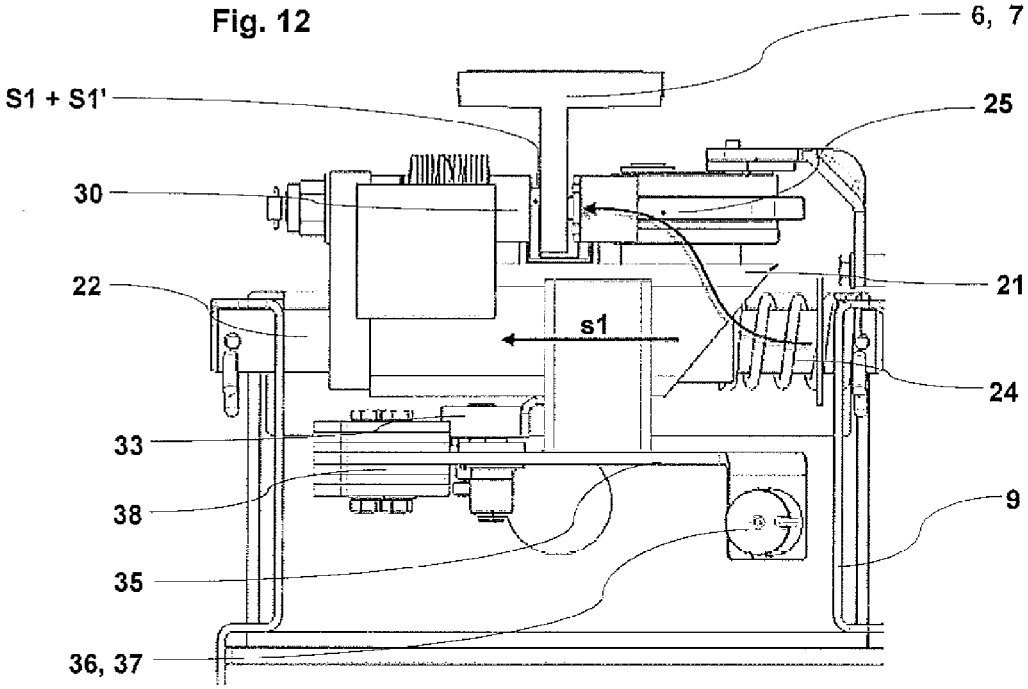
FIG. 12 shows a plan view of the brake of FIG. 8 in the second operational setting.

The clamping electromagnet 36 is switched off for the purpose of actuation of the elevator braking device. Consequently, the blocking roller can no longer provide a blocking force, whereby the force store 35 can urge the brake housing 21 together with the brake element 25 against the brake surface 7 of the guide rail 6, as is illustrated in FIGS. 11 and 12. Due to the adjustment of the brake housing, a play between brake element 25 and brake surface 7 can be eliminated, whereas the play S1+S1' between brake plate 30 and rail 6 is increased in the first actuating step.

Figure 13:
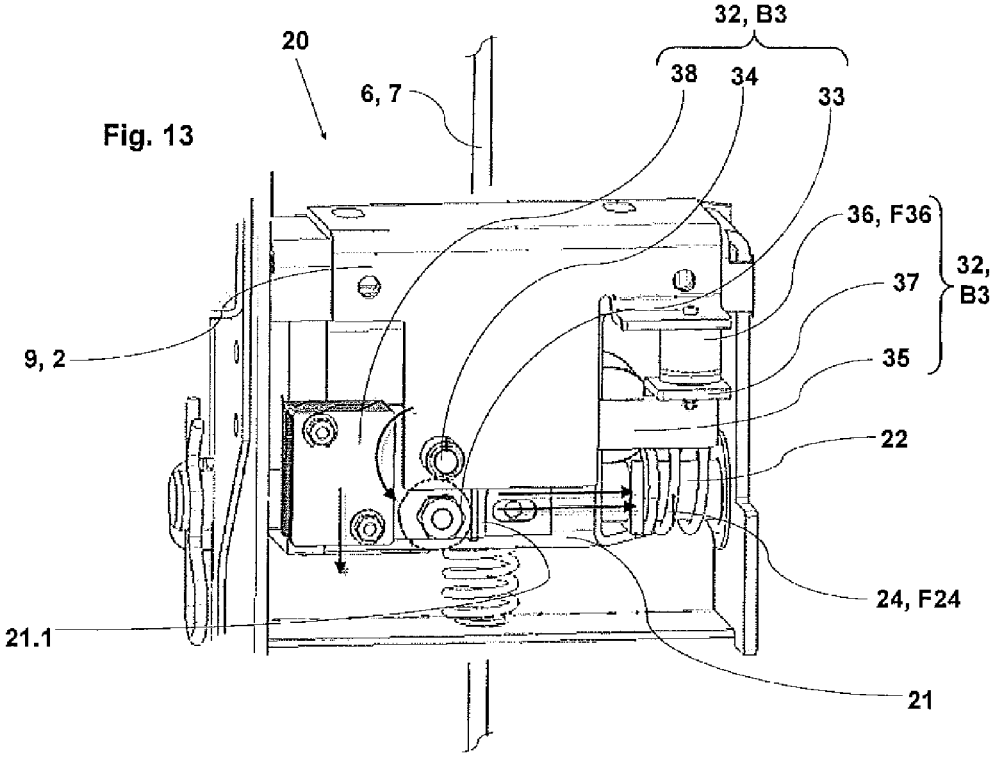
FIG. 13 shows a back view of the brake of FIG. 8 in the braking setting and FIG. 14 shows a plan view of the brake of FIG. 8 in the braking setting.
Figure 14:
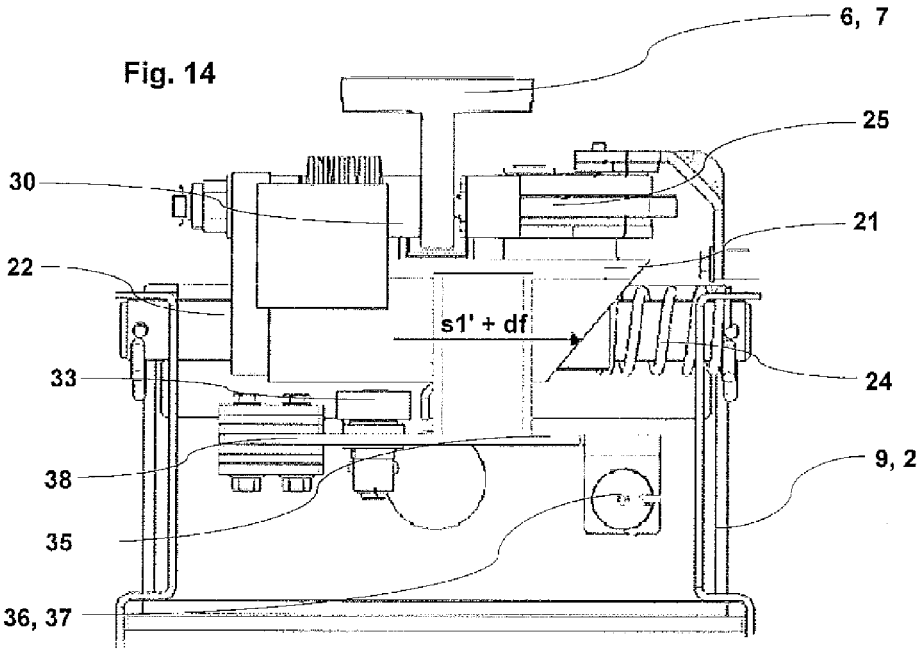

Through a relative movement between brake element 25 and guide rail 6 the control eccentric 25.1 of the brake element 25 is rotated and the brake shoe 25.2 is pressed by way of the control eccentric 25.1 against the brake surface 7 of the guide rail 6 (cf. FIG. 8), whereby braking of the elevator cage 2 takes place. In this regard the brake plate 30 is pulled up by way of the brake housing 21, whereby the guide rail 6 is clamped in place between the brake plate 30 and the brake shoe 25.2 and whereby at the same time the brake housing 21 is pushed back again in the direction of the first operational setting. The assisting weight 38 of the actuator 32 in that case ensures that the actuator 32 follows this resetting until the actuator 32 is disposed back in its original position corresponding with normal operation. This can mean that a holding mechanism of the actuator, for example an electromagnet or a latch, for fixing the actuator in this reset position B3 corresponding with the first operational setting B1 merely has to be switched on, whereby the actuator 32 is reset without a further resetting action. Accordingly, the holding mechanism can be of economic design. The elevator braking device 20 is shown in FIGS. 13 and 14 in the braking setting, wherein the actuator, as described, is disposed back in its position B3 corresponding with normal operation.

The illustrated arrangements can be varied. The brakes can be attached above or below the cage 2. In addition, several brake pairs can be used at a cage 2. The braking device can also be used in an elevator installation with several cages, wherein then each of the cages has at least one braking device of that kind. If needed, the braking device can also be attached to the counterweight 3 or it can be attached to a self-propelling cage.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator braking device, comprising:

a brake housing;

a brake element, the brake element being arranged in the brake housing by a rotary bearing, the brake element comprising a curved surface such that a radial spacing from the rotary bearing to the curved surface increases over a rotational angle;

a force store that can press the brake element against a brake surface; and an actuator that can act on the brake element and, in a first operational setting, urge the brake element against the force store and away from the brake surface, and that can, in a second operational setting, free the brake element and allow the force store to press the brake element against the brake surface, the actuator being configured to be moved into a reset position corresponding with the first operational setting as a result of the brake element being pressed against the brake surface and being entrained by a relative movement between the elevator braking device and the brake surface and thereby moving the actuator into the reset position.

2. The elevator braking device of claim 1, the brake surface being part of a rail guide.

3. The elevator braking device of claim 1, the brake element being incorporated into the brake housing, the force store and the actuator being configured to act on the brake element using the brake housing.

4. The elevator braking device of claim 3, the brake housing being mounted and being horizontally displaceable in a support, the actuator being mounted in the support.

5. The elevator braking device of claim 1, the curved surface comprising a center clamping region, the center clamping region being eccentrically shaped relative to the rotary bearing.

6. The elevator braking device of claim 5, the brake element further comprising a first braking region connected with the center clamping region.

7. The elevator braking device of claim 6, the brake element further comprising a second braking region connected with an end of the center clamping region opposite the first braking region.

8. The elevator braking device of claim 1, the brake element comprising a control eccentric, the control eccentric comprising the curved surface.

9. The elevator braking device of claim 1, further comprising a brake plate positioned to engage the brake surface or a guide rail opposite the brake element.

10. The elevator braking device of claim 9, further comprising a brake spring coupling the brake plate and the brake housing.

11. The elevator braking device of claim 1, the actuator comprising a clamping electromagnet with an armature plate, wherein in the first operational setting the armature plate bears against and is electromagnetically held by the clamping electromagnet, wherein the armature plate, when the actuator is brought into the reset position corresponding with the first operational setting, contacts the clamping electromagnet in a current-free state of the clamping electromagnet.

12. The elevator braking device of claim 11, the actuator being settable to enable setting of the first operational setting.

13. The elevator braking device of claim 1, the actuator comprising an assisting weight, the assisting weight holding an entrainer in contact with the brake element or the brake housing.

14. The elevator braking device of claim 13, the entrainer comprising a blocking roller.

15. The elevator braking device of claim 1, the actuator comprising an assisting spring, the assisting spring holding an entrainer in contact with the brake element or the brake housing.

16. The elevator braking device of claim 15, the entrainer comprising a blocking roller.

17. An elevator installation, comprising:

an elevator cage;

a guide rail; and an elevator braking device, comprising, a brake housing, a brake element, the brake element being arranged in the brake housing by a rotary bearing, the brake element comprising a curved surface such that a radial spacing from the rotary bearing to the curved surface increases over a rotational angle, a force store that can press the brake element against a brake surface, and an actuator that can act on the brake element and, in a first operational setting, urge the brake element against the force store and away from the brake surface, and that can, in a second operational setting, free the brake element and allow the force store to press the brake element against the brake surface, the actuator being configured to be moved into a reset position corresponding with the first operational setting as a result of the brake element being pressed against the brake surface and being entrained by a relative movement between the elevator braking device and the brake surface and thereby moving the actuator into the reset position.

18. The elevator installation of claim 17, the guide rail being a first guide rail and the elevator braking device being a first elevator braking device, the elevator installation further comprising:

a second guide rail, the first and second guide rails being arranged on opposite sides of the elevator cage;

a second elevator braking device; and a synchronization rod coupling the first and second elevator braking devices.

* * * * *